United States Patent [19]

Schlippes

[11] Patent Number: 4,619,546

[45] Date of Patent: Oct. 28, 1986

[54] JUTTED JOINT STRUCTURES

[76] Inventor: Hans-Josef Schlippes, 325 Bord de L'Eau, Ste. Dorothee, Laval P. Q., Canada, H7X 1S8

[21] Appl. No.: 665,633

[22] Filed: Oct. 29, 1984

[30] Foreign Application Priority Data

Nov. 14, 1983 [CA] Canada ..... 1171231

[51] Int. Cl.[4] ..... F16B 11/00; F16D 3/00

[52] U.S. Cl. ..... 403/171; 403/176; 403/219; 403/390

[58] Field of Search ..... 403/219, 218, 217, 170, 403/171, 176, 389, 390, 396

[56] References Cited

U.S. PATENT DOCUMENTS

| | | | |
|---|---|---|---|
| 2,461,003 | 2/1949 | Schwinn | 403/217 |
| 2,472,572 | 6/1949 | Dailey | 403/217 |
| 2,662,778 | 12/1953 | Ristow | 403/217 X |
| 2,765,580 | 10/1956 | Herrschaft | 403/217 X |
| 2,886,359 | 5/1959 | Herrschaft | 403/171 |
| 3,060,258 | 10/1962 | Spurgeon | 403/218 X |
| 3,123,879 | 3/1964 | Boduroff et al. | 403/217 |
| 3,563,579 | 2/1971 | Reiner | 403/362 |
| 3,647,242 | 3/1972 | Pawsat et al. | 403/217 X |

FOREIGN PATENT DOCUMENTS

| | | | |
|---|---|---|---|
| 493681 | 1/1977 | Australia | 403/218 |

*Primary Examiner*—Cornelius J. Husar
*Assistant Examiner*—Peter M. Cuomo
*Attorney, Agent, or Firm*—Thomas N. Neiman

[57] ABSTRACT

Faced with the necessity to establish a mechanical connection between the components of a supporting structure, a great many techniques and devices have been developed. This invention adds to the existing repertory a joint where a plurality of elongated members, positioned in a circular configuration, is held together by a link which embraces them all at once, thus eliminating the need for separate fastening devices on each and every single member. The elongated members protrude from the joint at predetermined angles projecting towards adjacent joints in a predetermined distance, thereby defining in shape and size entire structures. The joints may be secured against rotation and shifting, individually by means of pins or keys, or collectively by fitting trigonal, tetragonal or pentagonal panels between a corresponding number of joints.

9 Claims, 8 Drawing Figures

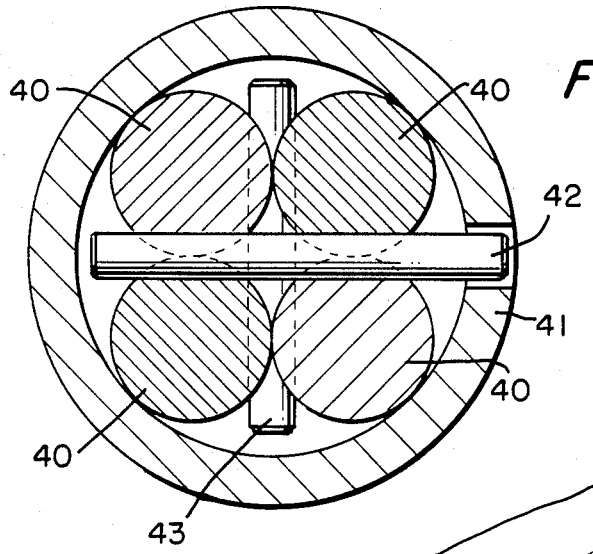
FIG. 6
FIG. 4
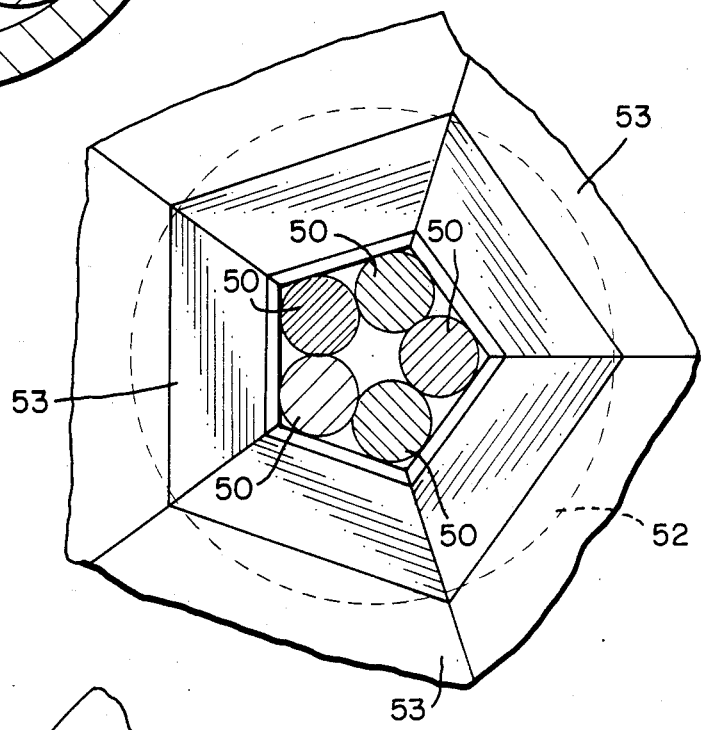
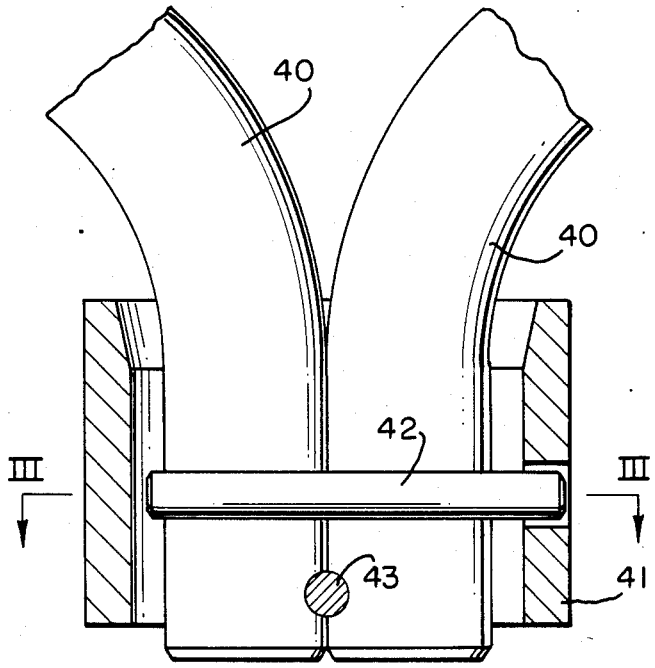
FIG. 5

JUTTED JOINT STRUCTURES

This invention relates to a method of attaching to one another the components of a supporting structure and the panels or other construction elements required to complete such architecture as may be suitable for a particular purpose.

Amongst a multitude of fastening devices the familiar hook-and-eye concept has found wide spread acceptance as a reliable means to counteract separating forces in a single line of action. A mechanical connection is sustained in the presence of these forces and readily disengaged in their absence. This effect is desirable in many instances, however, it also restricts the utility of the apparatus.

I have found that hook-and-eye connections can be adapted to form rigid joints capable of transmitting forces in all directions with a design which provides a sufficient increase in the number of lines and/or areas of contact for all components, in order to exclude the possibility of any relative movements within the assembly.

Furthermore, I have found that the concept can be expanded to encompass an infinite variety of applications in the field of solid geometry by translating the stereometric correlations of angles and distances into simple construction elements which are then joined together following four basic patterns:

1. The centers of three elongated members coincide with the corners of an equilateral triangle in the cross-section of the joint. This pattern reappears in the four joints of a tetrahedronal structure and in the twenty joints of a dodecahedronal structure.
2. The centers of four elongated members describe a square in the cross-section of the joint. This pattern occurs in the six joints of a octahedronal structure.
3. The centers of five elongated members describe a pentagon in the cross-section of the joint. This pattern is evident in the twelve joints of an icosahedronal structure.
4. The centers of six elongated members describe a hexagon in the cross-section of the joint. This pattern is applicable for joints required in the construction of quasi-spherical bodies derived from icosahedronal structures by fragmentation of surfaces in accordance with spherical trigonometry.

The end portions of elongated members participating in the formation of a joint enclose an angle with the construction element which they are attached to or form an integral part of. A joint may be introrse or extrorse depending on this angle measuring $\alpha°$ in the first instance and $(180-\alpha)°$ in the second instance without any change to the overall shape of a structure.

For elongated members of equal length outlining the boundaries of regular solid bodies the angle is measured in a plane through the centerline at both ends.

In the case of a tetrahedron $\alpha=35.26°$.

In case of a hexahedron $\alpha=54.74°$.

In case of an octahedron $\alpha=45°$.

In case of a dodecahedron $\alpha=69.09°$.

In case of an icosahedron $\alpha=58.28°$.

For triangular panels of equal size enclosing regular solid bodies the angle $\alpha$ is measured in planes perpendicular on the lines bisecting the corners of the panels.

In case of a tetrahedron $\alpha=19.47°$.

In case of an octahedron $\alpha=35.26°$.

In case of an icosahedron $\alpha=52.62°$.

In case of rectangular panels enclosing a cube or rectangular prism the angle $\alpha$ is 35.26° measured in planes perpendicular on the lines bisecting the corners of the panels.

In case of pentagonal panels of equal size enclosing a dodecahedron the angle $\alpha$ is 52.62° measured in planes perpendicular on the lines bisecting the corners of the panels.

The versatility of the system which lies in the combination of four basic patterns of joints with the appropriately angled construction elements can be further extended by coupling a plurality of structures together. This is achieved by mounting two or more units back to back, side by side and/or on top of each other. In order to do so, the design of the construction elements may be changed to integrate the angled end portions of elongated members on both sides of a line or plane of contact between two construction elements to form a single construction element. This creates an unlimited potential for the design of structures and their components with joints which remain essentially unchanged in their basic construction. The features of these joints will become apparent from the following detailed description, which, taken in conjunction with the annexed drawings discloses preferred embodiments of the present invention.

In drawings which illustrate embodiments of the invention:

FIG. 4 is a section of the line II—II of FIG. 3;

FIG. 5 is an elevation in longitudinal section of another embodiment joining four elongated members;

FIG. 6 is a section of the line III—III of FIG. 5;

Figure 2:
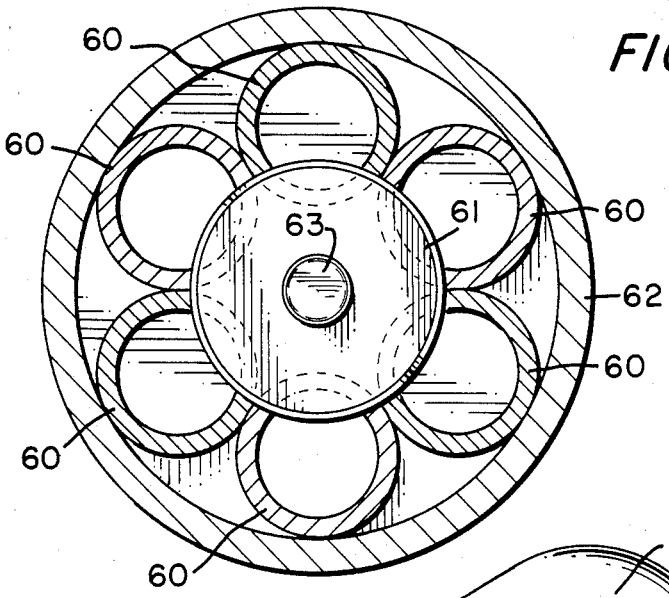
FIG. 2 is a section of the line I—I of FIG. 1.
Figure 3:
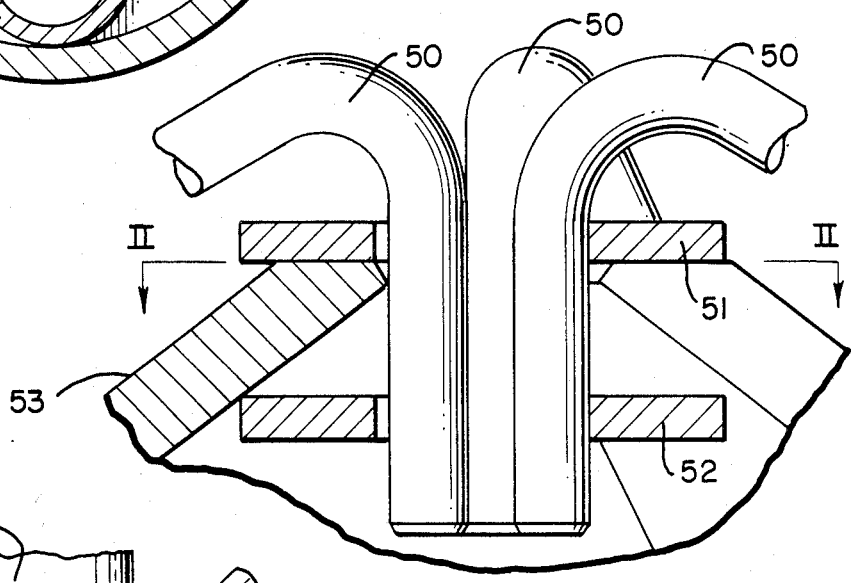
FIG. 3 is an elevation in longitudinal section of another embodiment joining five elongated members.
Figure 1:
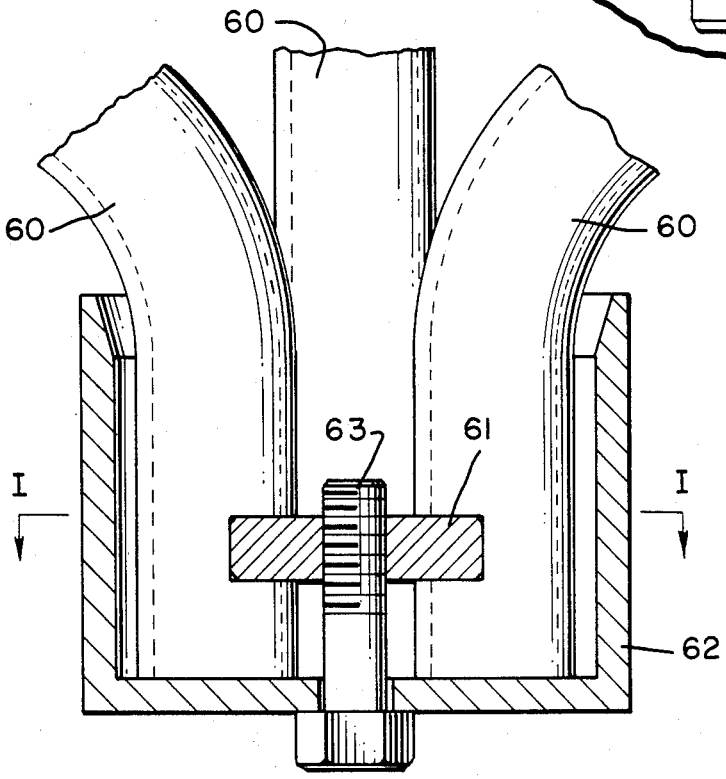
FIG. 1 is an elevation in longitudinal section of one embodiment joining six elongated members.

Referring to the drawings in further detail, the apparatus illustrated in FIGS. 1 and 2 comprises six elongated members 60 which are adapted to permit assembly around a cylindrical key 61 and subsequent mounting of a retaining cup 62. The elongated members may be of any suitable cross-section, but, the end portions shown represent pipes or tubing with bent portions preceeding the straight portions which participate in the formation of the joint. The key is engaged with the contours of cutouts in the elongated members and prevents them from turning or shifting in any direction when the retaining cup is secured in its position with a bolt 63 which is screwed into the threaded hole in the key. In the embodiment shown in FIGS. 3 and 4 representing one of twelve identical joints of an icosahedronal structure, there are five elongated members 50 held together by two retaining discs 51 and 52. The discs support five triangular panels 53 in appropriately adapted corners. The panels, confined to one position between adjacent joints and panels, in turn, stabilize the joint and provide external indexing for its components. The spacing of the discs further increases the stability of the joint.

In the embodiment shown in FIGS. 5 and 6, there are four elongated members 40 held together by a retaining sleeve 41. The elongated members are locked in position by two pins 42 and 43 one of which penetrates the wall of the retaining sleeve to secure the assembly.

Figure 7:
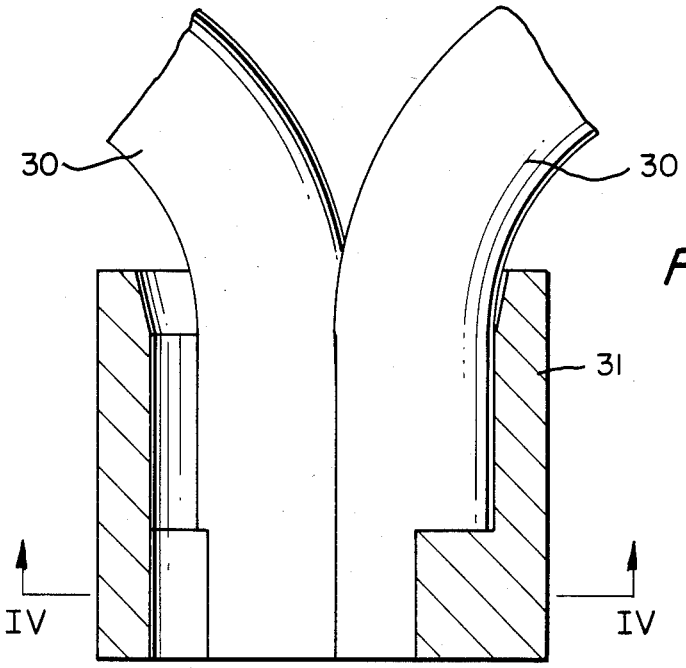
FIG. 7 is an elevation in longitudinal section of another embodiment joining three elongated members.
Figure 8:
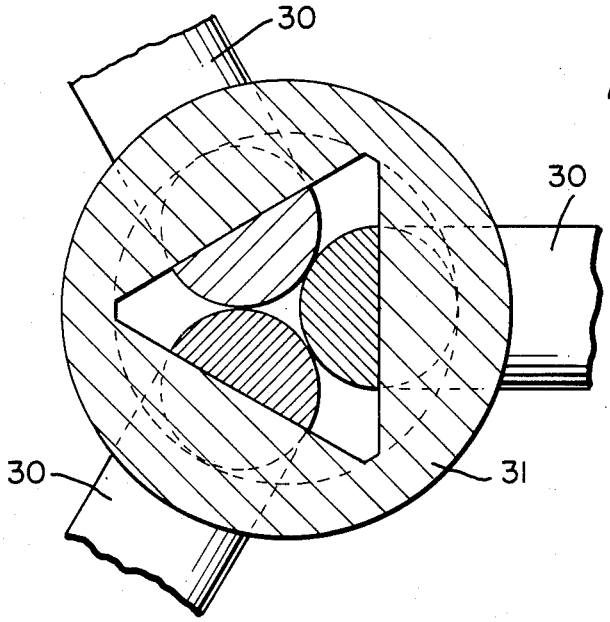
FIG. 8 is a section of the line IV—IV of FIG. 7.

In the embodiment illustrated in FIGS. 7 and 8 there are three elongated members 30 held together by a retaining socket 31. The elongated members are positioned in a triangular hole in the bottom part of the socket matching the flat surfaces at the end of the elongated members in assembled position. The integrity of the joint may be secured by additional means, but, in the form shown depends on the friction between the lines and areas of contact within the joint.

Accordingly, while I have described my invention in connection with a specific embodiment thereof, it is clearly to be understood that this is done only by way of example and not as a limitation to the scope of my invention as set forth in the objects therof and in the claims.

I claim:

1. An apparatus for joining together multiple pieces of structure comprising:

elongated members;

said elongated members have angled end portions;

indexing means, interposed between recessed surfaces provided in said end portions of said elongated members in order to form a joint and to secure the alignment of said joint and to prevent shifting in any direction;

said elongated members, positioned in radial orientation towards the center of said joint with said angled end portions parallel side by side in a circular configuration;

said angled end portions being maintained in engaged juxtaposition to each other;

retaining means; and said retaining means, surrounding portions of said elongated members to hold them in their assembled position.

2. An apparatus according to claim 1, wherein: at least two of said elongated members are joined together.

3. An apparatus according to claim 1, wherein:

said elongated members have at least two of said angled end portions, one at each end, projecting towards a common point of intersection of their centerlines.

4. An apparatus according to claim 1, wherein:

said elongated members have at least two of said angled end portions parallel to each other.

5. An apparatus according to claim 1, wherein:

said elongated members have at least two of said angled end portions at each end.

6. An apparatus according to claim 1, wherein:

said angled end portions are obtained by bending to form integral parts of said elongated members.

7. An apparatus according to claim 1, wherein:

said angled end portions are obtained by attaching bent end portions to said elongated members.

8. An apparatus according to claim 1, wherein:

said angled end portions are obtained by attaching straight end portions at an angle to said elongated members.

9. An apparatus according to claim 1, wherein:

said indexing means consists of a cylindrical key centered on the axis of the joint.

* * * * *